US009950411B1

(12) United States Patent
Clover

(10) Patent No.: US 9,950,411 B1
(45) Date of Patent: Apr. 24, 2018

(54) APPARATUS AND METHODS FOR THREADING A NUT ALONG AN ELONGATE MEMBER

(71) Applicant: Don K. Clover, Katy, TX (US)

(72) Inventor: Don K. Clover, Katy, TX (US)

( * ) Notice: Subject to any disclaimer, the term of this patent is extended or adjusted under 35 U.S.C. 154(b) by 477 days.

(21) Appl. No.: 14/593,859

(22) Filed: Jan. 9, 2015

Related U.S. Application Data

(63) Continuation-in-part of application No. 13/507,102, filed on Jun. 4, 2012, now abandoned.

(51) Int. Cl.
*B25B 21/00* (2006.01)
*B25B 13/48* (2006.01)

(52) U.S. Cl.
CPC ..... *B25B 21/00* (2013.01); *B25B 13/481* (2013.01)

(58) Field of Classification Search
CPC ... B25B 21/005; B25B 21/00; B25B 23/0078; B25B 21/002; B25B 21/02; B25B 13/481; B25B 17/00; B25B 21/026; B25B 23/0028; B25B 23/12
See application file for complete search history.

(56) References Cited

U.S. PATENT DOCUMENTS 2,532,027 A 6/1948 Maddox
2,671,369 A * 3/1954 Clark ..... B25B 23/12 7/901
2,817,256 A 12/1957 Malone
3,477,318 A 11/1969 Batten
3,564,953 A 2/1971 Able
3,602,071 A * 8/1971 Juhasz ..... B25B 21/002 81/57.14
3,913,428 A 10/1975 Brunson
3,987,691 A 10/1976 Savage
3,987,692 A 10/1976 Lesner
4,171,651 A 10/1979 Dacunto
4,374,479 A 2/1983 Minotti
4,374,480 A 2/1983 Diaz
4,825,729 A 5/1989 Puncochar
4,928,558 A 5/1990 Makhlouf
5,339,710 A 8/1994 Deadmond
5,522,285 A * 6/1996 Wilson, Jr. ..... B25B 13/48 81/57.14
5,544,553 A * 8/1996 Galat ..... B25B 13/481 81/57.13
5,697,266 A * 12/1997 Wilson, Jr. ..... B25B 13/461 81/57.14
5,732,605 A 3/1998 Mann
(Continued)

*Primary Examiner* — Robert Scruggs

(57) ABSTRACT

Apparatuses and methods are disclosed for threading a nut along a stud or similar elongate member, including use of a contact member within a first orifice that engages the nut, and a torque transfer member within a second orifice that engages both the contact member and a power source, such as an air ratchet. Torque from the power source causes movement of the torque transfer member, which, in turn, causes movement of the contact member, thereby threading or unthreading the nut along the stud or other elongate member. The first orifice includes a through bore for accommodating passage of the elongate member, while the body of the apparatus can include ferromagnetic members for preventing loss of the nut and additional structures for limiting undesired movement of the power source or apparatus through contact.

20 Claims, 4 Drawing Sheets

(56) References Cited

U.S. PATENT DOCUMENTS

| | | | | |
|---|---|---|---|---|
| 5,775,182 | A | 7/1998 | Plakinger | |
| 5,860,335 | A | 1/1999 | Lund | |
| 5,927,156 | A | 7/1999 | Landwehr | |
| 6,035,745 | A | 3/2000 | Kather | |
| 6,164,166 | A | 12/2000 | Whiteford | |
| 6,330,840 | B1 | 12/2001 | McCormick | |
| 6,408,720 | B2 | 6/2002 | Collins | |
| 6,945,139 | B1 * | 9/2005 | Johnson | B25B 13/481 81/177.2 |
| 7,290,464 | B1 | 11/2007 | Walter | |
| 7,721,627 | B2 * | 5/2010 | Basham | B25C 7/00 81/57.14 |
| 7,827,885 | B2 | 11/2010 | Rowell | |
| 2003/0221520 | A1 * | 12/2003 | Ha | B25B 13/06 81/57.36 |
| 2004/0065176 | A1 * | 4/2004 | Lin | B25B 13/06 81/125 |
| 2004/0093991 | A1 | 5/2004 | Wojtynek | |
| 2008/0196554 | A1 | 8/2008 | Tutino | |
| 2010/0288081 | A1 | 11/2010 | Nguyen | |

* cited by examiner

APPARATUS AND METHODS FOR THREADING A NUT ALONG AN ELONGATE MEMBER

This application is a continuation-in-part of and claims priority to U.S. patent application Ser. No. 13/507,102, filed on Jun. 4, 2012, the disclosure of which is incorporated herein by reference.

FIELD

Embodiments usable within the scope of the present disclosure relate, generally, to apparatuses and methods for applying a force (e.g., torque) to an object, and more specifically, to apparatuses and methods for threading a nut along an elongate member, such as when securing a flange.

BACKGROUND

Attachment of adjacent segments of a conduit having flanges is generally performed by abutting the flanges of two conduit segments, such that a series of bores extending through the flanges are aligned to create a continuous through-hole that extends through the flanges of both conduit segments. When attaching a single conduit segment to an object or a surface, the bores through the conduit flange can be aligned with receiving holes in the object to which the conduit segment is to be secured. In either case, through these aligned holes, a stud having external threads is positioned, the stud extending a significant length beyond the upper surface of the flange(s). Using the studs, the flanges of a conduit segment can be secured in an abutting relationship, by threading one or more nuts, or similar fasteners, along the stud until the nuts abut the flanges.

Forming an attachment of this nature is normally very time consuming and tedious, primarily due to the large number of nuts that must be threaded in this manner to make a single connection. A typical flanged connection may require installation of a dozen or more studs, and the threading and torqueing of twice that number of nuts, one on each stud, on each side of the flanged connection. When it is necessary to unmake a connection (e.g., when a segment of conduit requires replacement), it is equally time consuming and tedious to unthread the nuts along the full length of the studs.

As an alternative to manually threading and unthreading nuts along their respective studs, pneumatic nut runners can be used to rapidly spin the nuts. However, many limited access locations include closely-spaced flanges and objects, where insertion of such a device and placement of the device over a stud would be difficult, if not impossible. Additionally, it is common for many nuts to be dropped and/or otherwise lost when being positioned for engagement or shortly after disengagement from a stud. Further, use of a nut running device can sometimes result in damage or injury when installing a nut, e.g., when the nut abuts the flange and the continued force generated by the device causes the device to forcefully contact an adjacent object.

A need exists for apparatuses and methods usable to rapidly engage and disengage nuts or similar members along a stud, usable within limited access and/or low-clearance areas.

A further need exists for apparatuses and methods usable to retain a nut therewith when moving the nut into and from engagement with a stud.

A need also exists for apparatuses and methods usable to limit undesired movement of a device relative to the nut being engaged, e.g., after abutment of the nut against a flange or other object.

Embodiments usable within the scope of the present disclosure meet these needs.

SUMMARY

Embodiments usable within the scope of the present disclosure include apparatuses and methods for threading nuts or similar objects along an elongate member (e.g., a stud). Generally, an apparatus having a body with a first and second orifice formed therein is provided, the first orifice having a contact member for engaging a nut and transferring torque thereto, and the second orifice having a torque transfer member in association therewith. A power source (e.g., an air ratchet) can be engaged with the torque transfer member (e.g., through the second orifice), such that actuation of the power source causes movement (e.g., rotation) of the torque transfer member. The torque transfer member can in turn be engaged with the contact member (e.g., through a geared arrangement with interlocking teeth, or similar means), such that the contact member moves responsive to actuation of the power source. The contact member can be shaped for engaging the nut, such as through inclusion of an interior, hexagonal profile for engagement with a hex nut, such that movement of the contact member causes rotation of the nut.

The body of the apparatus can be provided with a tapered shape, e.g., having a first width at a first end and a second, lesser width at a second end. The body can further be provided with a generally short height (e.g., a low clearance) to facilitate access between closely-spaced flanges and/or objects. For example, the thickness of a nut used in most applications is generally equal to the diameter of the stud, to facilitate proportionality of the thread width of the stud relative to the nut. To ensure the ability of the body to access a space through which a nut will be installed, the body of the apparatus can be provided with a thickness less than or equal to that of the nut, such that the body of the apparatus is capable of accessing any space able to be accessed by the nut. Similarly, the body of the apparatus can be provided with a width selected to fit between adjacent nuts on either side thereof, disposed on a flange, the distance between nuts corresponding to API standards, ANSI standards, and/or other similar standards To prevent undesired movement of the power source relative to the body and/or the power source or body relative to the nut, the power source can be fixedly engaged with the torque transfer member, e.g., through the second orifice, such as through attachment of a frame or similar member over the power source, the frame being connected to the body. In an embodiment, the power source can be removably and interchangeably engaged with the body for enabling efficient replacement and/or selective use of power sources having desired characteristics. For example, while in a preferred embodiment, the power source can include an air ratchet, in other embodiments, an electrical power source can be used. Typically, an electrical power source can produce torque efficiently per unit of power consumed, and relative to the size of the power source. Alternatively or additionally, one or more members can be attached to the body, extending on one or both sides of the power source, such that lateral movement of the power source will impact the member, thus limiting movement of the power source in a manner that could cause damage or injury. Similarly, lateral movement of the apparatus, itself, e.g., immediately after a nut contacts a flange, can be prevented through contact between the member and the conduit and/or adjacent studs or nuts.

In an embodiment, the contact member and/or another portion of the first orifice can include one or more ferromagnetic members (e.g., magnets) embedded therein or placed thereon, usable to retain the nut within the orifice. Use of magnets or similar ferromagnetic members in this manner enables retention of the nut within the first orifice during movement and transit of the apparatus. For example, it is common for a nut to be inadvertently dropped when moving a nut runner having the nut therein into a position for engagement with a stud. Similarly, after disengaging a nut, it is common for the nut to fall from the first orifice when attempting to move the nut runner away from the stud. Use of ferromagnetic members enables the nut to be securely placed in the orifice, both before engagement and after disengagement, and moved into and from a position suitable for engagement with the stud, the magnetic members retaining the nut within the orifice during movement of the apparatus. The first orifice, body, and/or contact member can further include stand-off members (e.g., bolts or similar contact members), which urge the apparatus, the magnets, and/or the nut apart from one another one the nut is engaged, e.g., through continued application of force by the power source.

As such, an embodied apparatus usable within the scope of the present disclosure can be provided into engagement with a nut, e.g., through engaging a nut with the contact member of the apparatus, and providing a power source into engagement with the torque transfer member. Once the apparatus and nut are positioned for engagement with a stud or similar elongate member, the power source can be actuated to cause movement of the torque transfer member, thereby causing movement of the contact member, which in turn contacts and moves the nut along the stud while the stud passes through the through-bore of the orifice within which the nut is retained. As described previously, embodiments of the present apparatus can be used bidirectionally, such that nuts can be disengaged through the reverse process. Conventional nut runners must be inverted or otherwise reconfigured to turn a nut in the reverse direction, while embodiments of the present apparatus can be bidirectionally operable.

Embodied methods of use can also include methods for threading and/or otherwise moving a stud or similar elongate member, relative to one or more nuts. For example, a nut can be threaded along a stud along which an additional nut has been positioned. When the first nut contacts the additional nut, further movement of the nut along the stud is impeded; however, continued actuation of the power source can cause forces to be transmitted through the nut to the stud, causing rotation of the stud for threading (or unthreading) the stud into a flange or similar receptacle.

Embodiments usable within the scope of the present disclosure thereby provide apparatuses and methods usable to rapidly move nuts along a stud or similar member, bidirectionally, that are usable within low-clearance areas, and that can include features for limiting undesired movement and/or loss of the nut, and/or limiting undesired movement of the apparatus.

BRIEF DESCRIPTION OF THE DRAWINGS

In the detailed description of various embodiments usable within the scope of the present disclosure, presented below, reference is made to the accompanying drawings, in which.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein are illustrative and explanatory of one or more example embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose example embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

Embodiments usable within the scope of the present disclosure relate to apparatus and methods for applying torque and/or other forces to a first object to move the first object relative to a second object. Specific embodiments, include an apparatus for threading and/or unthreading a nut along a stud, such as when securing a flange to an abutting flange or other object.

Figure 1:
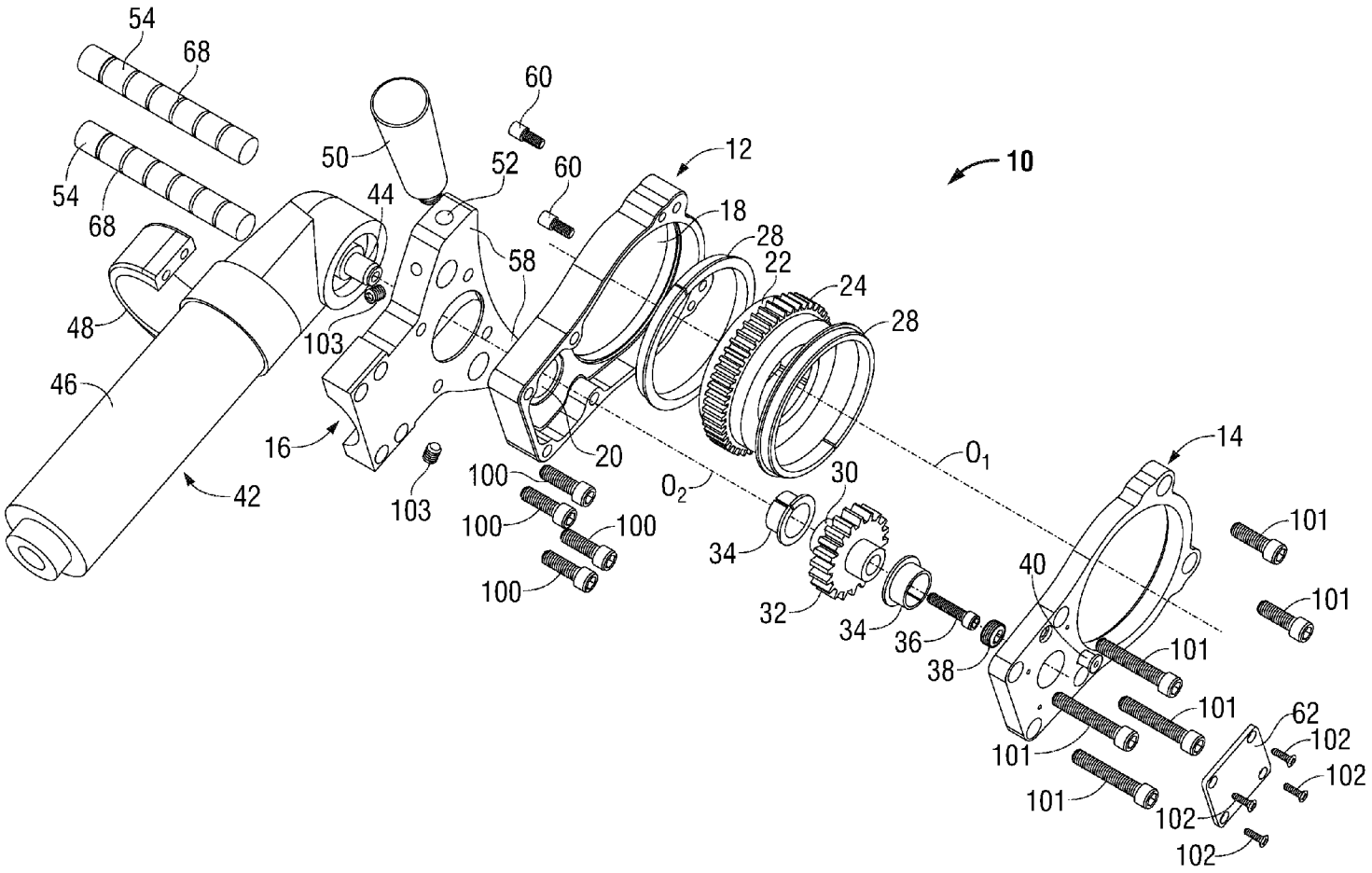
FIG. 1 depicts an exploded view of an embodiment of an apparatus usable within the scope of the present disclosure.

Referring now to FIG. 1, an exploded view of an embodiment of a nut running apparatus (10) is shown, the apparatus comprising a body (12), a top plate (14), and a frame (16), secured to an air ratchet (42). While FIG. 1 depicts a body (12) and top plate (14) having substantially similar profiles, with protruding corners and a rounded portion, it should be understood that embodiments usable within the scope of the present disclosure can include any shape and/or dimensions, as desired, to facilitate access to a stud or similar elongate member, and transmission of torque form a power source to a nut for engagement therewith.

The body (12) and top plate (14) include a first orifice (18) formed therethrough, whose alignment between the exploded parts is indicated in FIG. 1 by the line $O_1$. Additionally, the body (12), top plate (14), and frame (16) include a second orifice (20) formed therethrough and adjacent to first orifice (18). The alignment of second orifice (20) between the exploded parts is indicated in FIG. 1 by the line $O_2$. In the depicted embodiment, the first and second orifices (18, 20) do not intersect; however, it should be understood that any placement and/or arrangement of orifices (18, 20), including embodiments intersecting to form a continuous orifice, can be used without departing from the scope of the present disclosure.

A contact member (22) is shown sized for placement within the first orifice (18) at the body (12). Specifically, the contact member (22) is depicted as a ring-shaped member having teeth (24) on the exterior surface thereof, and a hexagonal contact surface (26) on the interior surface thereof adapted for engaging and transmitting torque to a hex nut or similar fastener. Other types of contact surfaces can be usable for engaging nuts and/or fasteners having other shapes and/or external features. Two bushings (28) and/or other covers or spacing members can be used to secure the contact member (22) within the body (12) in a manner that permits rotation of the contact member (22). Additionally, the body (12) is shown having threaded stand-off studs (60).

A torque transfer member (30) is shown sized for placement within the second orifice (20) at the body (12), the torque transfer member (30) depicted here as a ring and/or disc-shaped member having teeth (32) on an exterior surface thereof. As with the contact member (22), two bushings (34) and/or guides secure the torque transfer member (30) within the second orifice (20). Additionally, a threaded screw or bolt (36) is secured through the torque transfer member, in a manner that permits rotation of the torque transfer member thereabout (30). The threaded bolt (36) is positioned adjacent to a set screw (38), which is preferably oriented opposite the threaded bolt (36) (e.g., if the bolt (36) is left-handed, the set screw (38) is right-handed), thus providing protection against the bolt (36) backing out during operation of the torque transfer member (30). Additionally, a grease fitting (40) located on top plate (14) allows convenient lubrication of the torque transfer member (30) and associated elements.

When the torque transfer member (30) is secured within the second orifice (20) and the contact member (22) is secured within the first orifice (18), the teeth (32) of the torque transfer member (30) interlock with the teeth (24) of the contact member (22), such that rotation of the torque transfer member (30) causes rotation of the contact member (22), which can in turn cause rotation of a nut engaged with the contact surface (26) thereof.

FIG. 1 further depicts an air ratchet (42) positioned for engagement with the body (12) such that an operative portion of the air ratchet (44) (depicted here as a rotatable square pin) is engageable with the torque transfer member (30) through the second orifice (20). While the operative portion of the air ratchet (44) engages the torque transfer member (30) through the second orifice (20), the body of the air ratchet (46) can be secured to the frame (16) of the apparatus to prevent undesired movement of the air ratchet (42) relative to the body (12). Specifically, FIG. 1 depicts a frame (16) having a brace (48) sized to encircle the body of the air ratchet (46), the brace (48) ad frame (16) being secured together using screws (100) or similar fasteners. A removable frame (16) facilitates interchangeability of the air ratchet (42), e.g., when different forces and/or different types of power sources are desired.

The frame (16) is shown having a handle (50), which can be threadably inserted into handle orifices (52) on either side of frame (16) according to user's hand preference and/or to position the apparatus at a corner. (The second handle orifice is not depicted but is located on opposing side of frame (16)). Additionally, the frame (16) comprises two blocking portions (58), which extend laterally on either side of second orifice (20).

The position of the blocking portions (58) mitigates undesired lateral movement of the apparatus (10). For example, when threading a nut along a stud, at the moment the nut abuts the flange or another similar object, continued actuation of the air ratchet (42) may cause a sudden torque force to be experienced by a user holding the air ratchet (42) or other portion of the apparatus (10). This force can cause the air ratchet (42), the apparatus (10), or a portion of the user's body to move suddenly, possibly with great force, to impact a nearby object, especially when the apparatus (10) is used in a location with limited clearance and/or access. In the depicted embodiment, lateral movement of the apparatus (10), relative to the flange and/or other object being secured will cause one of the blocking portions (58) to impact an adjacent nut and/or stud, the conduit, and/or another portion associated with the flange as the apparatus (10) moves laterally and/or rotationally. Limiting movement of the apparatus (10) in this manner can prevent damage thereto and/or injury to a user. While FIG. 1 depicts two blocking portions (58), it should be understood that a single blocking portion can effectively limit movement of the apparatus (10), such as during operations when torque is applied by the air ratchet (42) in a single direction.

To further limit movement, blocking portions (58) of frame (16) also contain bores (56) sized to receive reaction members (54). Reaction members (54) are further adjustable within bores (56) through the use of threaded reaction fasteners (103) located on the lateral edge of frame (16) in communication with bores (56), which allow the user to loosen or tighten the fit of reaction members (54) within bores (56) or remove them from the apparatus entirely.

The position of the reaction members (54) further prevents undesired lateral movement of the air ratchet (42) relative to the remainder of the apparatus (10). Specifically, the reaction members (54) are shown positioned on opposing sides of the air ratchet (42), such that undesired lateral movement of the air ratchet (42) (e.g., upon continued actuation of the air ratchet (42) after abutment of a nut against a flange), is restricted through contact between the air ratchet (42) and the reaction members (54), and/or through contact between the reaction members (54) and an object adjacent to the apparatus (10). While FIG. 1 depicts two reaction members (54) positioned on opposing sides of the air ratchet (42), in various embodiments, it should be appreciated that, as with the blocking portions (58), a single reaction member can be effective for purposes of a unidirectional torque, and in other embodiments, use of reaction members could be omitted.

Thus, while reaction members (54) prevent movement through physical contact with the power source (42) or the apparatus (10), blocking portions (58) restrict undesirable movement by making contact with an adjacent object, such as an adjacent nut, stud, flange, surface, etc. If apparatus (10) is over-torqued, blocking portions (58) of frame (16) may prevent damage to the body (12) or to user's hand if the impact occurred directly along the side of apparatus (12).

Furthermore, it can be appreciated that while reaction members (54) are depicted within blocking portions (58) of frame (16), reaction members (54) may be attached at other locations, such as directly to body (12). As such, any combination of the depicted reaction members (54) or blocking portions (58) could be used, and in other embodiments, use of blocking portions and reaction members could be omitted.

The top plate (14) is shown attached through to body and frame via screws (101) extending therethrough. The top plate (14) is depicted with a cover plate (62), secured to top plate (14) via screws (102), which covers second orifice (20). Cover plate (62) functions here to protect the components located within the second orifice (20) from the elements and prevent lubricant introduced via grease fitting (40) from leaking and also provides additional bracing against the set screw (38) which is threaded opposably from bolt (36) to secure the torque transfer member (30).

It should be understood that while FIG. 1 depicts an air ratchet (42) removably secured to the body (12) using a frame (16), in various embodiments, other pneumatic and/or other types of power sources (e.g., electrical, hydraulic, mechanical, and/or other power sources) could be used in lieu of the depicted air ratchet (42), and any means of connection and/or engagement known in the art and/or other methods for limiting undesired movement of the power source relative to the body (12) can be used. For example, FIG. 1 depicts a receiving bore (56) within the frame (16), usable to receive a reaction member (54) for limiting lateral movement of the air ratchet (42) relative to the body (12).

Figure 2:
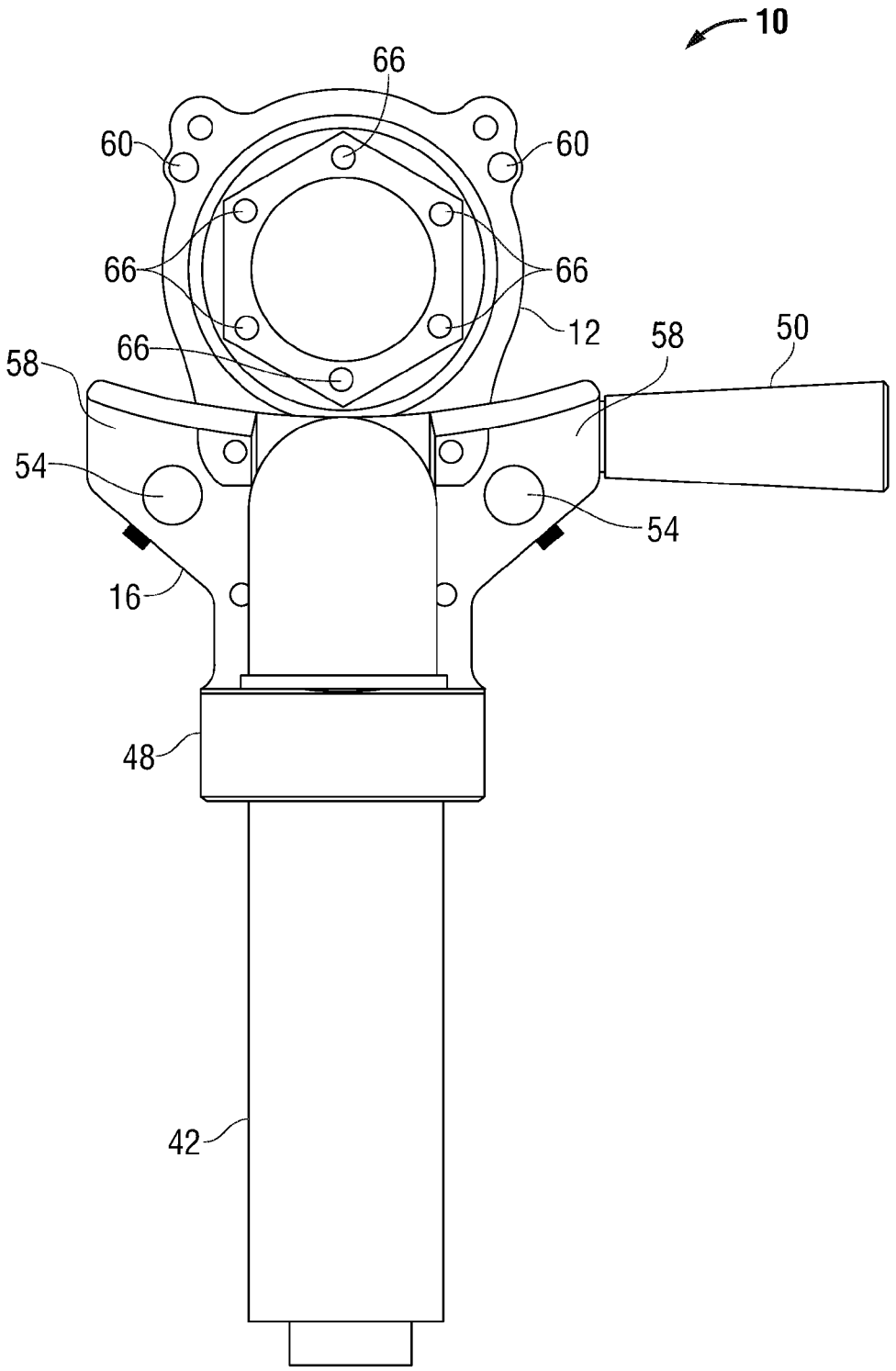
FIG. 2 depicts a plan view of an embodiment of an apparatus usable within the scope of the present disclosure.

Referring now to FIG. 2, an embodiment of the apparatus (10) is shown in plan view. Here it can be seen that the contact surface (26) comprises a plurality of ferromagnetic elements (66) for retaining a nut during operation of the apparatus (10). These ferromagnetic elements (66) can be retained on the contact surface (26) through any number of conventional means, such as glue or other adhesive and/or by fitting into correspondingly sized depressions in the contact surface (26). While the depicted embodiment contains six ferromagnetic elements (66) it should be appreciated that any number of such elements may be used as fit the shape of the contact surface (26). It also should be appreciated that in some embodiments the discrete ferromagnetic elements (66) may be absent, and all or any portion of the contact surface (26) or body (12) proximate to the first orifice (18) may be magnetized. The studs (60) (also depicted in FIG. 1) of the body (12) enable the apparatus (10) to physically separate from the nut when strong ferromagnetic elements (66) are used. The studs (60) ensure the apparatus (10) will physically abut the flange; thus, the rotation of the contact member (22) along the last portion of the threaded member will cause the nut to separate slightly from the ferromagnetic elements (66) during the last few rotations.

Figure 3:
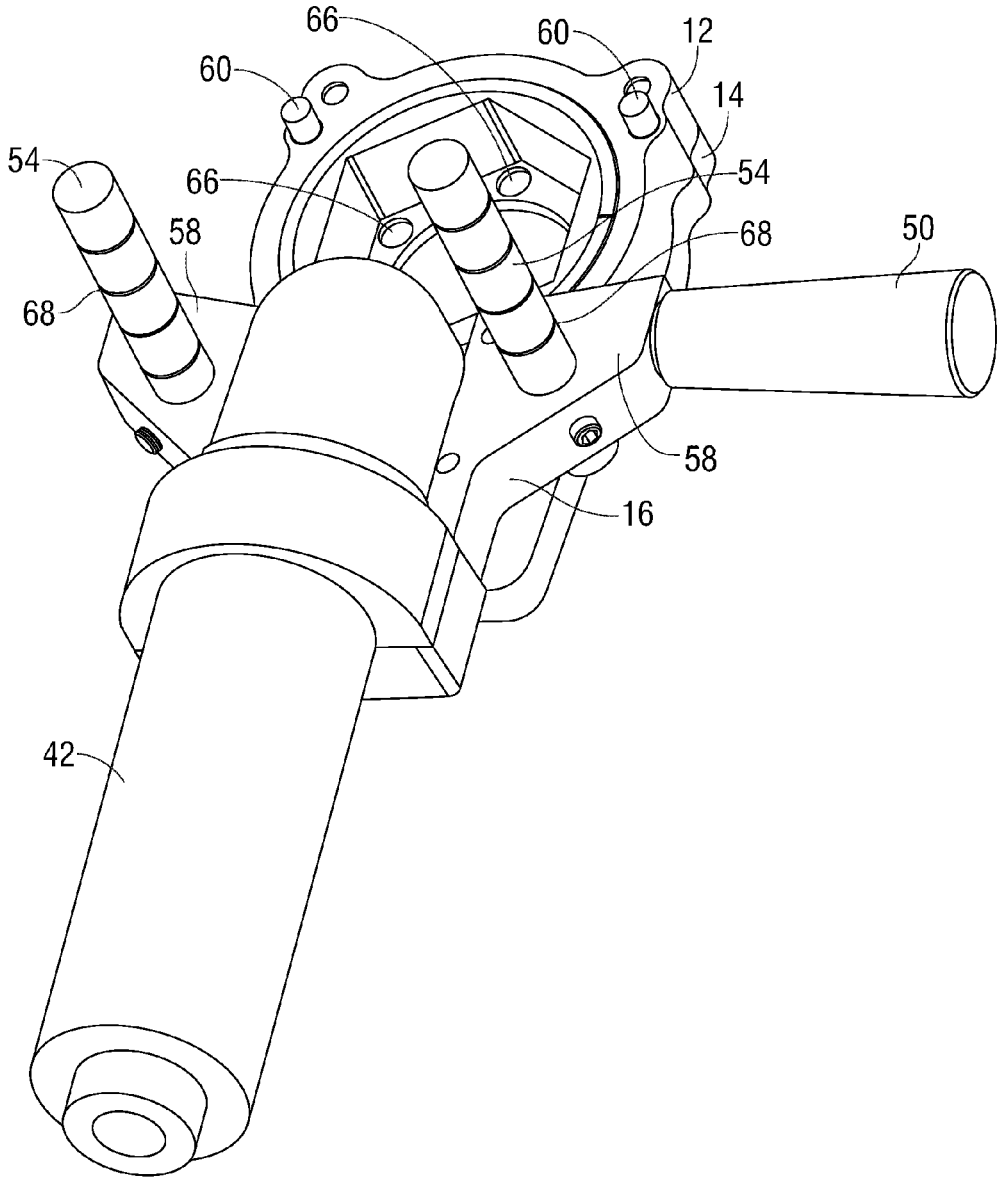
FIG. 3 depicts a perspective view of an embodiment of an apparatus usable within the scope of the present disclosure.

Referring now to FIG. 3, a perspective view of an embodiment of the apparatus (10) is shown, in which the body (12) and frame (16) are visible. The contact member (22), having inner surface (26), is shown disposed within the first orifice (18) of the body, as described previously, and the air ratchet (42) is shown secured to the body (12) by frame (16) and brace (48). As described previously, two reaction members (54) are shown, usable to prevent undesired lateral and/or rotational and/or angular movement of the air ratchet (42) and/or the apparatus (10). Specifically, the reaction members (54) are shown secured through respective bores (56, shown in FIG. 1) of the frame (16) via reaction fasteners (103). It should be appreciated that, while the embodiment depicts the reaction members (54) positioned through the frame (16), they may also be positioned on the sides of the body (12), or any other location suitable to block torque-induced movement of the air ratchet (42) relative to the apparatus (10) or vice versa. Additionally, it should be understood that a single reaction member (54) can effectively limit movement of the air ratchet (42) and/or apparatus (10), such as during operations when torque is applied by the air ratchet (42) in only a single, known direction. The frame (16) is also shown including a removable handle (50), usable to provide the apparatus (10) with an additional location for gripping and/or manipulating the apparatus (10).

Figure 4A:
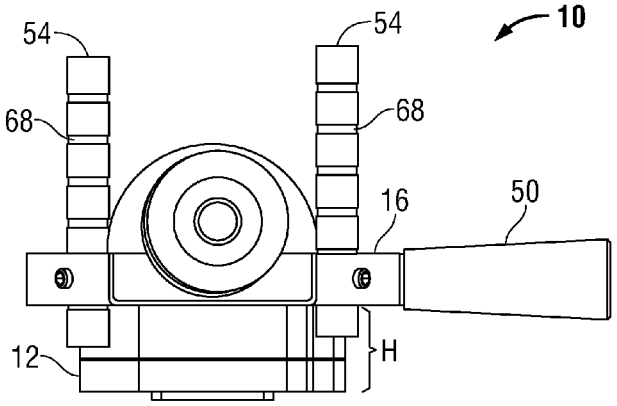
FIG. 4A depicts an end view of an embodiment of an apparatus usable within the scope of the present disclosure.
Figure 4B:
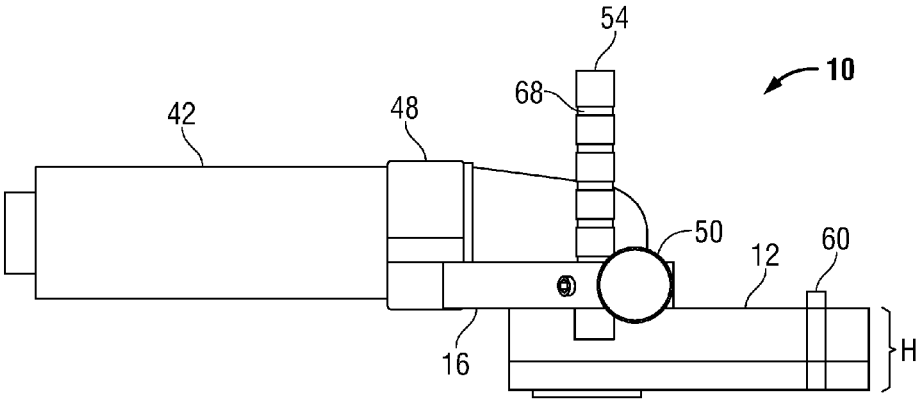
FIG. 4B depicts a side view of an embodiment of an apparatus usable within the scope of the present disclosure.

Referring now to FIGS. 4A and 4B, an end view and side view, respectively, of an embodiment of the apparatus (10) is shown. As previously described, the apparatus (10) includes a body (12) secured to a front plate (14) and a frame (16), the frame being secured to the air ratchet (42) via a brace (48). Also of note, the body (12) is shown having a generally limited profile height (H) for facilitating insertion thereof into low-clearance areas. Typically, the height (H) can be less than or equal to that of a nut to be secured using the apparatus (10).

The depicted embodiment is also shown including the reaction members (54) secured to respective bores (56, depicted in FIG. 1) of the frame (16) using threaded fasteners (103). Here it can be seen that the reaction members (54) comprise circumferential grooves (68) located at corresponding points on each reaction member (54) to enable standardized, uniform positioning of the reaction members (54) using the fasteners (103) relative to each other or a preselected length. It can be appreciated that in other embodiments, the reaction members (54) may be directly connected to or formed integrally of the frame (16) or body (12).

The present disclosure thereby provides apparatus and methods usable to rapidly move nuts along a stud or similar elongaet member, bidirectionally, that are usable within limited access and/or low clearance areas, and that can include blocking and/or reaction members or similar features for limiting undesired movement of the apparatus and ferromagnetic members for preventing loss of the nut.

While various embodiments usable within the scope of the present disclosure have been described with emphasis, it should be understood that within the scope of the appended claims, the present invention can be practiced other than as specifically described herein.

What is claimed is:

1. An apparatus for threading a nut along an elongate member, the apparatus comprising:

a body;

a frame secured external to the body;

a power source secured to the frame;

a first orifice extending through the body, the first orifice containing a contact member for engaging the nut and transferring torque thereto, wherein the first orifice and the contact member accommodate passage of the elongate member;

a second orifice extending through the body and the frame, the second orifice containing a torque transfer member disposed within the body in association with the contact member, wherein the torque transfer member is configured to receive torque from the power source positioned adjacent to the second orifice; and a top plate secured to the body, wherein the first orifice extends through the top plate, the top plate comprising a cover plate enclosing the second orifice, wherein the torque from the power source causes movement of the torque transfer member, and wherein movement of the torque transfer member causes movement of the contact member, thereby causing movement of the nut along the elongate member.

2. The apparatus of claim 1, wherein the torque transfer member is operably connected to the power source via a first threaded connector, wherein the first threaded connector is locked against a second threaded connector, wherein the first threaded connector and second threaded connector are threaded in opposing orientations.

3. The apparatus of claim 1, wherein the contact member comprises a first plurality of teeth located on an outer surface thereof, and wherein the first plurality of teeth engage a second plurality of teeth formed on the torque transfer member.

4. The apparatus of claim 1, wherein the contact member comprises an inner surface having a shape complementary to the shape of the nut.

5. The apparatus of claim 1, wherein the contact member comprises at least one ferromagnetic member for retaining the nut in association therewith.

6. The apparatus of claim 5, wherein the body comprises at least one separation stud extending in a direction parallel to the elongate member.

7. The apparatus of claim 1, further comprising at least one reaction member positioned on a side of the second orifice and extending in a direction parallel to the elongate member for limiting movement of the power source relative to the body, limiting movement of the body relative to the power source, or a combination thereof.

8. The apparatus of claim 7, wherein the frame, the body, or combinations thereof comprise a bore, wherein the at least one reaction member is secured therethrough.

9. The apparatus of claim 1, wherein the frame contains at least one blocking portion extending laterally from the apparatus.

10. The apparatus of claim 1, wherein the power source is secured to the frame via a removable brace.

11. An apparatus for threading a nut along an elongate member, the apparatus comprising:

a body;

a frame secured external to the body;

a power source secured to the frame;

a first orifice extending through the body, the first orifice containing a contact member for engaging the nut and transferring torque thereto, wherein the first orifice and the contact member accommodate passage of the elongate member; and a second orifice extending through the body and the frame, the second orifice containing a torque transfer member disposed within the body in association with the contact member, wherein the torque transfer member is operably connected to receive torque from the power source via a first threaded connector and positioned adjacent to the second orifice, wherein the first threaded connector is locked against a second threaded connector, wherein the first and second threaded connectors are threaded in opposing orientations, wherein the torque from the power source causes movement of the torque transfer member, and wherein movement of the torque transfer member causes movement of the contact member, thereby causing movement of the nut along the elongate member.

12. The apparatus of claim 11, further comprising a top plate secured to the body, wherein the first orifice extends through the top plate, the top plate comprising a cover plate enclosing selectively sealed conduit to the second orifice.

13. The apparatus of claim 11, wherein the contact member comprises a first plurality of teeth located on an outer surface thereof, and wherein the first plurality of teeth engage a second plurality of teeth formed on the torque transfer member.

14. The apparatus of claim 11, wherein the contact member comprises an inner surface having a shape complementary to the shape of the nut.

15. The apparatus of claim 11, wherein the contact member comprises at least one ferromagnetic member for retaining the nut in association therewith.

16. The apparatus of claim 15, wherein the body comprises at least one separation stud extending in a direction parallel to the elongate member.

17. The apparatus of claim 11, further comprising at least one reaction member positioned on a side of the second orifice and extending in a direction parallel to the elongate member for limiting movement of the power source relative to the body, limiting movement of the body relative to the power source, or a combination thereof.

18. The apparatus of claim 17, wherein the frame, the body, or combinations thereof comprise a bore, wherein the at least one reaction member is secured therethrough.

19. The apparatus of claim 11, wherein the frame contains at least one blocking portion extending laterally from the apparatus.

20. The apparatus of claim 11, wherein the power source is secured to the frame via a removable brace.

* * * * *